US006227737B1

(12) United States Patent
Lightfoot

(10) Patent No.: US 6,227,737 B1
(45) **Date of Patent: *May 8, 2001**

(54) FLUID APPLICATORS

(75) Inventor: Mark Roger Lightfoot, Reading (GB)

(73) Assignee: The Gillette Company, Boston, MA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/096,816

(22) Filed: Jun. 12, 1998

Related U.S. Application Data

(63) Continuation of application No. PCT/US96/19885, filed on Dec. 12, 1996.

(30) Foreign Application Priority Data

Dec. 15, 1995 (GB) ..... 9525696

(51) Int. Cl.[7] ..... A46B 11/00

(52) U.S. Cl. ..... 401/129; 401/130; 15/209.1; 15/244.1; 118/264; 132/317; 132/320

(58) Field of Search ..... 15/104.94, 143.1, 15/144.1, 144.2, 209.1, 244.1, 244.2; 118/264; 132/317, 318, 320; 401/129, 130; 604/1

(56) References Cited

U.S. PATENT DOCUMENTS

| | | | | |
|---|---|---|---|---|
| 720,051 | * | 2/1903 | Moss et al. | 15/143.1 |
| 933,938 | | 9/1909 | Windle et al. | 401/264 |
| 1,828,485 | | 10/1931 | Allen | 401/202 |
| 2,282,406 | | 5/1942 | Hollenbeck | 401/264 |
| 2,291,676 | | 8/1942 | Baker | 401/130 |
| 2,314,539 | | 3/1943 | Hollenbeck | 401/264 |
| 2,397,080 | | 3/1946 | Baker | 401/130 |
| 2,409,933 | | 10/1946 | Fleisher et al. | 401/264 |
| 2,453,201 | | 11/1948 | Cushman | 401/207 |
| 2,481,803 | | 9/1949 | Weaver | 401/207 |
| 3,134,124 | * | 5/1964 | Horn | 15/244.1 |
| 3,262,461 | * | 7/1966 | Kambersky | 401/129 X |
| 3,554,657 | | 1/1971 | Aston | 401/122 |

(List continued on next page.)

FOREIGN PATENT DOCUMENTS

| | | | | |
|---|---|---|---|---|
| 3024381 | * | 1/1982 | (DE) | 132/320 |
| 3303-341 | | 8/1984 | (DE) . | |
| 0 053 573 | | 10/1981 | (EP) . | |
| 0 119 506 | | 2/1984 | (EP) . | |
| 641045 | | 7/1928 | (FR) . | |
| 682638 | | 5/1930 | (FR) . | |
| 989064 | | 9/1951 | (FR) . | |
| 1269178 | | 7/1961 | (FR) . | |
| 18586 | | 8/1914 | (GB) . | |
| 775009 | | 5/1957 | (GB) . | |
| 907102 | | 10/1962 | (GB) . | |
| 2 169 562 | | 7/1986 | (GB) . | |
| 2 216 785 | | 10/1989 | (GB) . | |
| 2 231 490 | | 11/1990 | (GB) . | |
| 2-102100 | | 4/1990 | (JP) . | |
| 9212863 | | 8/1992 | (WO) . | |
| WO 97/21554 | | 6/1997 | (WO) . | |

*Primary Examiner*—Mark Spisich
(74) *Attorney, Agent, or Firm*—Marshall, O'Toole, Gerstein, Murray & Borun

(57) ABSTRACT

An applicator for applying a fluid to a surface includes an applicator tip element (5) connected to the end of a substantially rigid stem (1) by a part (3) capable of flexing resiliently as the applicator tip element is stroked across a surface. The application element is conveniently formed as a pad or a molded member of porous material e.g. foam, which can be attached in various ways, e.g. by of adhesive, heat welding or mechanical fixing, to the resiliently flexible connection part.

11 Claims, 4 Drawing Sheets

U.S. PATENT DOCUMENTS

| | | | | |
|---|---|---|---|---|
| 3,568,236 | * | 3/1971 | Aston | 15/244.1 |
| 3,684,389 | | 8/1972 | Eron et al. | 401/207 |
| 4,208,145 | | 6/1980 | Azuma | 401/196 |
| 4,496,258 | | 1/1985 | Tanaka et al. | 401/206 |
| 4,509,540 | * | 4/1985 | Inagaki | 132/320 |
| 4,627,454 | | 12/1986 | Dahm | 132/318 |
| 4,712,266 | | 12/1987 | Yamaki | 15/167.1 |
| 4,712,571 | | 12/1987 | Remz et al. | 132/320 |
| 4,747,419 | | 5/1988 | Flynn et al. | 132/73 |
| 4,749,618 | | 6/1988 | Kawaguchi et al. | 428/375 |
| 4,792,252 | | 12/1988 | Kremer et al. | 401/206 |
| 4,812,071 | | 3/1989 | Batra et al. | 401/264 |
| 4,813,463 | | 3/1989 | Lin | 141/351 |
| 4,824,271 | | 4/1989 | Nagahama et al. | 401/196 |
| 4,848,947 | | 7/1989 | Kremer et al. | 401/206 |
| 4,913,175 | | 4/1990 | Yokosuka et al. | 132/317 |
| 4,923,317 | | 5/1990 | Bishop et al. | 401/205 |
| 4,960,340 | | 10/1990 | Tamiya et al. | 401/186 |
| 4,984,923 | | 1/1991 | Ota | 401/279 |
| 5,001,803 | * | 3/1991 | Discko, Jr. | 604/1 X |
| 5,035,524 | | 7/1991 | Sakurai | 401/206 |
| 5,073,058 | | 12/1991 | Fukuoka et al. | 401/260 |
| 5,082,386 | | 1/1992 | Hironaka et al. | 401/206 |
| 5,096,322 | | 3/1992 | Shiga et al. | 401/199 |
| 5,199,976 | | 4/1993 | Yau et al. | 523/161 |
| 5,299,877 | | 4/1994 | Birden | 401/206 |
| 5,306,755 | | 4/1994 | Yau et al. | 524/296 |
| 5,387,046 | | 2/1995 | Danno | 401/260 |
| 5,411,345 | | 5/1995 | Ueji et al. | 401/206 |
| 5,480,250 | | 1/1996 | Birden | 401/199 |
| 5,716,150 | | 2/1998 | Gueret | 401/129 |
| 6,033,143 | * | 3/2000 | Gueret | 401/129 |

* cited by examiner 1
2
3
4
5

1
6
3
4
5
FLEXING POINT

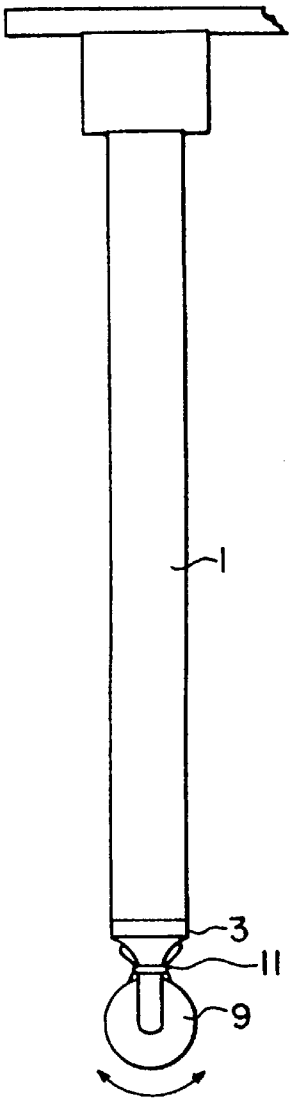
FIG. 4
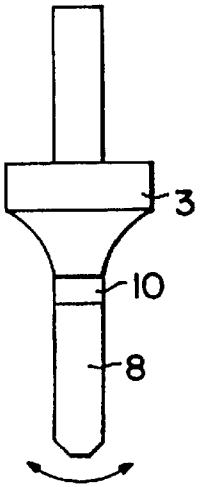
FIG. 5
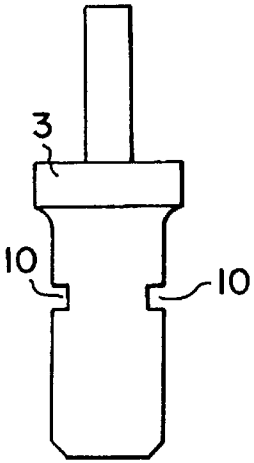
FIG. 6
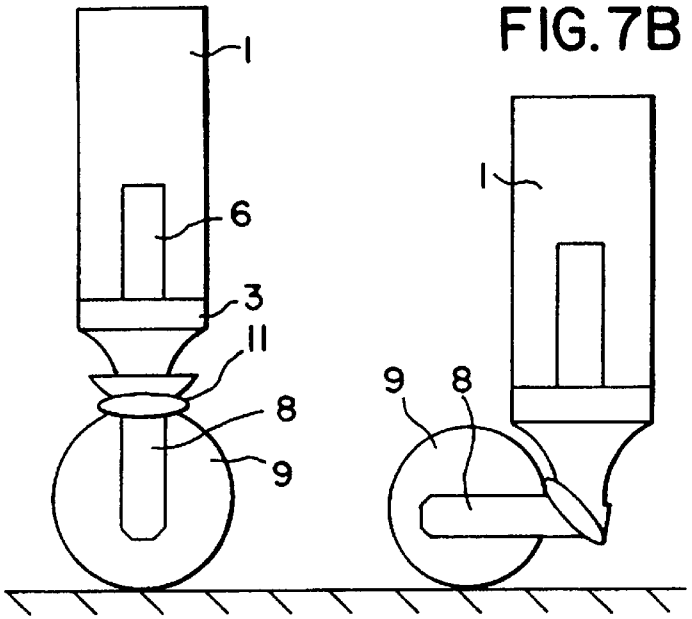
FIG. 7A
FIG. 7B

FLUID APPLICATORS

This is a continuation of copending application International Application PCT/US96/19885 filed on Dec. 12, 1996, and which designated the U.S.

This invention relates to applicators used to apply a fluid substance onto a surface. The invention is principally concerned with, and is specially described herein in relation to applicators for applying a correction fluid to a paper surface to facilitate the correction of typing or writing mistakes. It is known to supply correction fluid in a bottle provided with a cap which incorporates an applicator having a rigid stem extending from the underside of the cap, and an application element, most often a brush, carried at the free end of the stem. By holding the cap, the brush can be dipped into the fluid contained in the bottle to pick up a small portion of the fluid, and by applying the brush to the surface of a sheet of paper a fairly broad band or stripe of correction fluid can be deposited onto the paper. When not in use, the cap is secured to the bottle, e.g. by a screw-threaded connection, and the applicator is conveniently stored within the bottle. On the whole the known applicators of this kind work well. However, it can be difficult to lay down a stripe of fluid with uniform thickness and width over more than a short distance along the paper, e.g. when attempting to cover over complete words or more than one word, at least with a single stroke of the brush. As a consequence it is frequently necessary to stroke the brush along the paper several times, which is inconvenient.

In accordance with the present invention there is provided an applicator for applying a fluid to a surface, comprising an applicator tip element connected to the end of a substantially rigid stem by a part capable of flexing resiliently as the applicator tip element is stroked across a surface.

The application element should be capable of absorbing a portion of fluid when dipped into a body of the fluid, e.g. contained in a bottle, and of holding this fluid portion until the application element is applied to a surface. The application element is conveniently formed as a pad or a moulded member of porous material e.g. foam, which can be attached in various ways, e.g. by means of adhesive, heat welding or mechanical fixing, to the resiliently flexible connection part. It is also possible for the application element to be made of porous material and to be formed integrally with the resiliently flexible part.

The resiliently flexible part can be integral with the stem or it can be a separate part fixedly secured to the stem, e.g. by a root portion thereof being inserted into a bore provided in the end of the stem.

The resiliently flexible part may be capable of flexing in any direction, or it can be adapted e.g. in the manner of a living hinge, to define a predetermined axis about which the application element can pivot relative to the stem while being restrained against deflection in other directions.

The resiliently flexible connection part preferably allows the application element to deflect from a position substantially aligned with the stem to a position substantially at 90° thereto. When the application element is applied to a surface with a natural stroking action, which varies the angle at which the stem is inclined to the surface, there is a tendency to increase the force with which the application element presses against the surface. However with an applicator according to the invention, the application element can deflect due to the resiliency of the connection part, and the force against the paper does not vary greatly throughout the stroke. As a consequence the rate at which fluid is delivered onto the surface at the end of the stroke is not substantially different from that at the beginning of the stroke and a uniform stripe of fluid is obtained.

A full understanding of the invention will be gained from the following detailed description of some embodiments, reference being made to the accompanying drawings, in which:

FIG. 1 shows a first applicator embodying the invention;

FIGS. 2*a*–2*c* illustrate the flexing capability of the applicator tip of the FIG. 1 applicator;

FIGS. 3*a*–3*c* are similar to FIGS. 2*a*–2*c* but show a modified construction;

FIG. 4 shows another applicator embodying the invention;

FIG. 5 is a side view of the connection component of the applicator in FIG. 4;

FIG. 6 is a front view of the connection component of FIGS. 4 and 5;

Figure 12:
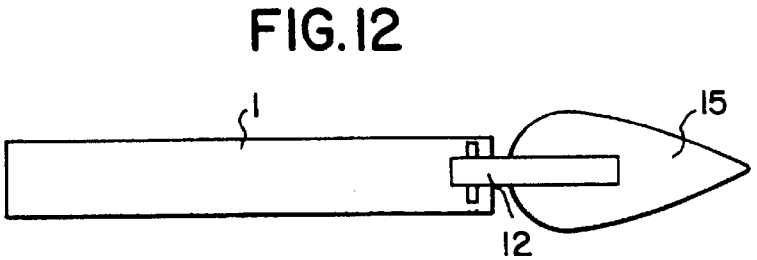
Figure 13A:
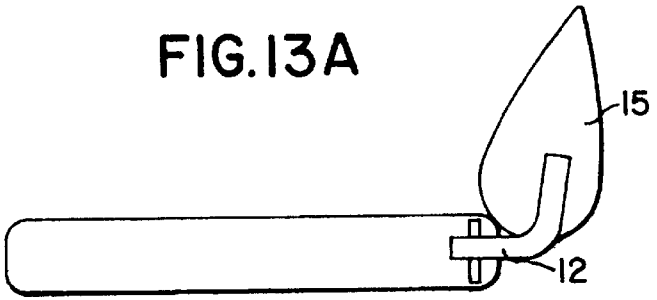
Figure 13B:
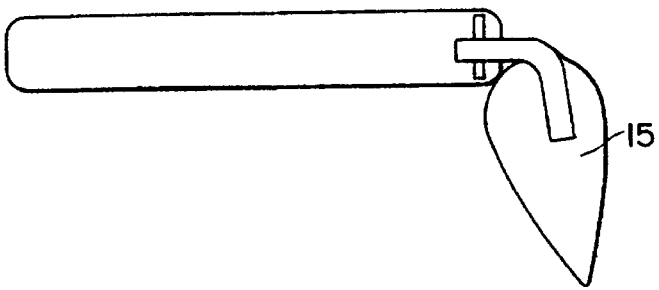
Figure 8:
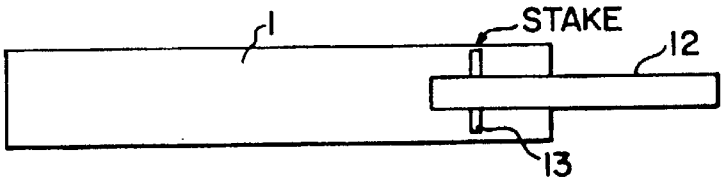
Figure 9B:
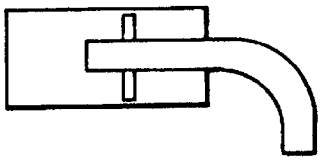
Figure 9A:
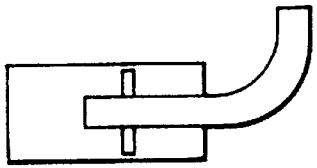
Figure 11:
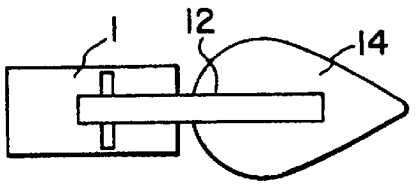
Figure 10:
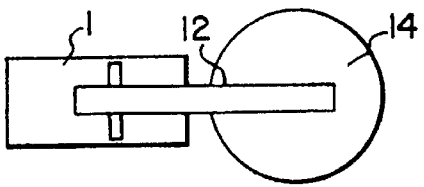

FIGS. 7*a* and 7*b* illustrate the flexing capability of the FIG. 4 embodiment;

FIG. 8 shows in axial section another applicator construction;

FIGS. 9*a* and 9*b* illustrate the flexing capability of the FIG. 8 embodiment;

FIGS. 10 and 11 show the applicator of FIG. 8 with respective forms of applicator tip element mounted to the flexible connection part;

FIG. 12 is an axial section showing yet another applicator embodying the invention; and FIGS. 13*a* and 13(*b*) illustrate the flexing capability of the application of FIG. 12.

Figures 1, 2A, 2B, 2C:
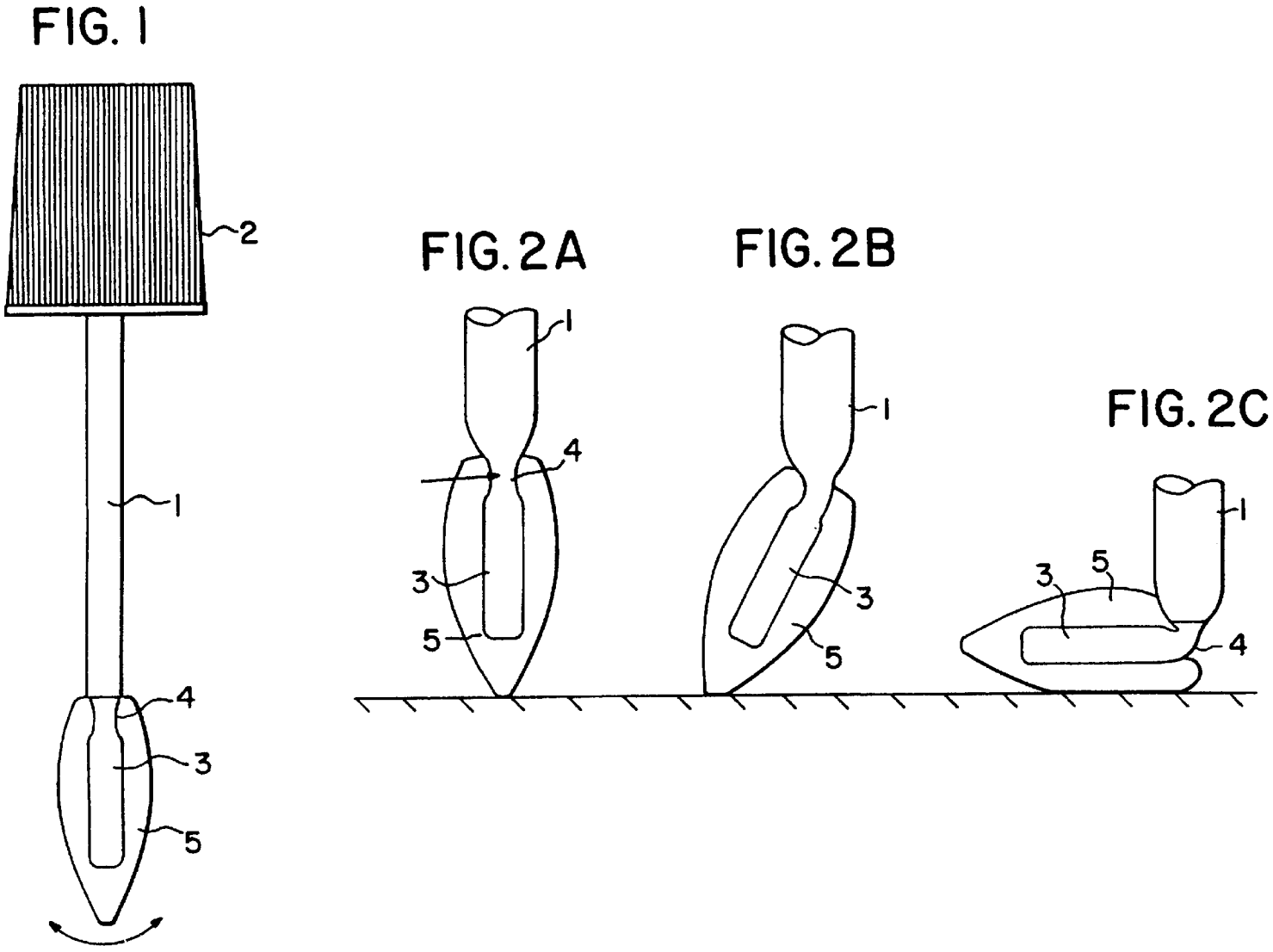

The correction fluid applicator shown in FIGS. 1 and 2 comprises a substantially rigid stem 1 attached to and projecting axially from the underside of a correction fluid bottle cap 2. At the lower end of the stem is a connection part 3 which is formed integrally with the stem.

The connection part includes a waisted section 4 of reduced diameter defining a flexing point about which a lower portion of this part is able to deflect resiliently between a normal position axially aligned with the stem (condition (a) in FIG. 2) to a position substantially at 90° to the stem (condition (c) in FIG. 2). Fixed onto the connection part 3 is an application element in the form of a moulded tip member 5 of open cell foam which can be any required shape, e.g. with a pointed tip or with a flat blade-like edge. The foam tip member can be secured in any convenient manner, such as by adhesive.

In use, the tip member is dipped into a body of correction fluid and absorbs some of the fluid. When the tip is applied to and moved across a surface with a natural stroking action, as the stroke progresses the connection part 3 flexes causing the tip member to deflect progressively from the normal in line position in accordance with the sequence (a)-(b)-(c) shown in FIG. 2. When the applicator is lifted from the surface at the end of the stroke, the connection part 3 and tip member 5 revert to their in-line positions due to the resilience of the material of the connection part. This resilience also ensures that the tip member is pressed with an even force against the paper thereby, assisting in delivering fluid from the tip member at a constant rate when the tip member is stroked across a paper surface.

Figures 3A, 3B, 3C:
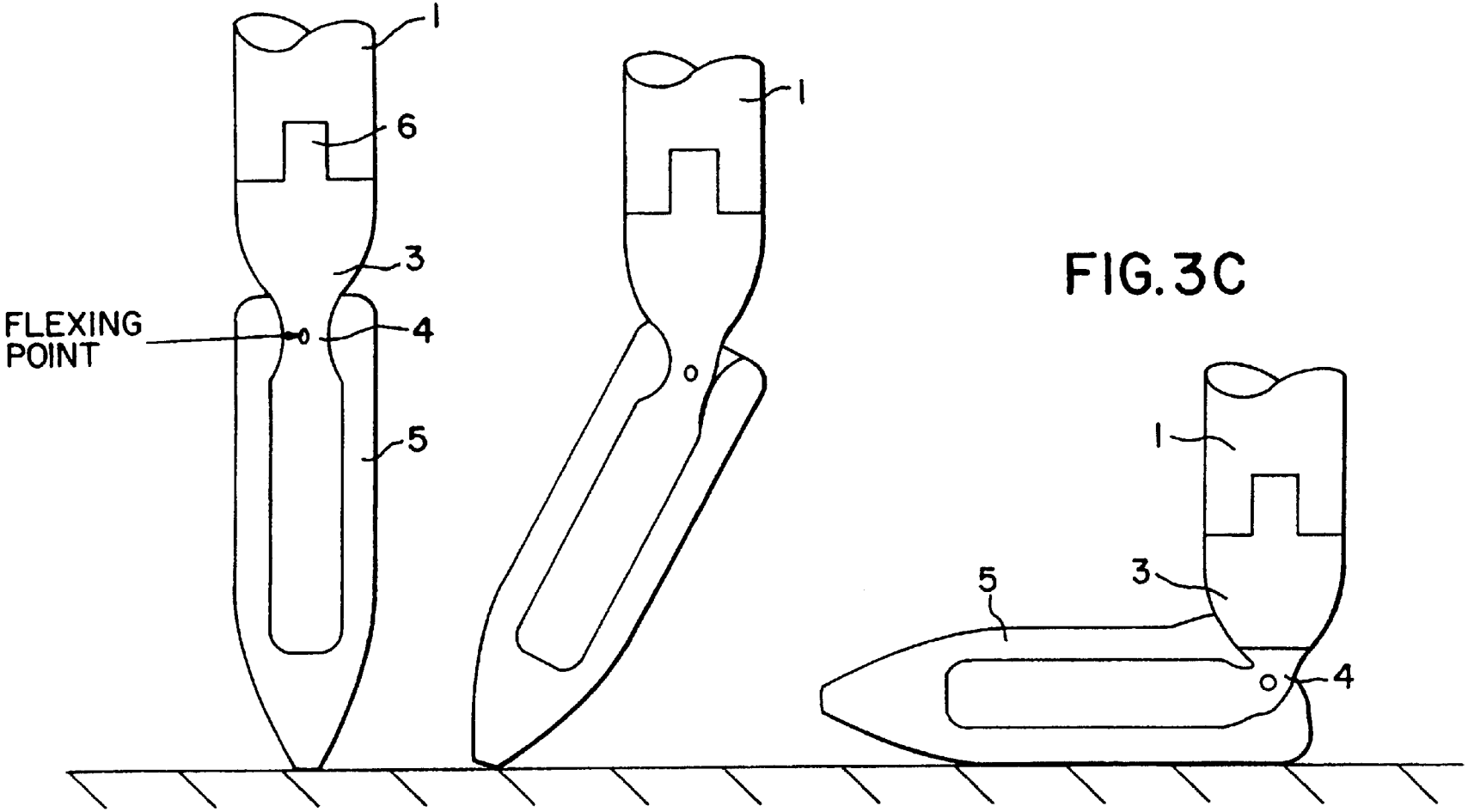

The applicator shown in FIG. 3 is largely the same as that of FIGS. 1 and 2 and it differs only in that the connection part is formed as a separate component and fastened to the end of the stem 1. Conveniently the connection part includes a root 6 or peg which is fitted into and secured in a blind bore provided at the end of the stem.

FIGS. 4–7 show another applicator with a separate connection part fixed to the stem 1 in the same way as described in connection with FIG. 3. The connection part 3 has a generally flat blade section 8 around the free end edge of which a pad 9 of open cell foam is wrapped to form an application element. The blade section includes a pair of opposed notches 10 in its side edges which define a flexing point at which the section will flex resiliently with respect to the stem. Due to the flat shape, the flexure occurs about a pivot axis, like a living hinge, the foam pad 9 being supported against movement relative to the stem in directions other than about the pivot axis. The notches 10 also serve to locate and retain a collar or monofilament 11 tied around the foam pad to secure it to the connection part. Of course other methods of fixing could be used to secure the foam pad.

In use the applicator of FIGS. 4–6 functions in essentially the same way as that of FIGS. 1–2, although the applicator in this instance needs to be oriented so that the pivotal axis about which flexing can occur is transverse to the direction of displacement of the foam pad application element over the paper surface. At the beginning of an application stroke the foam pad is aligned with the stem as indicated in FIG. 7(*a*), and at the end of a full stroke it will be at about 90° to the initial position, as shown in FIG. 7 (*b*).

FIGS. 8–11 illustrate an applicator in which the resiliently flexible connection part consists of a straight rod 12 of rubber-like material, or suitably resilient plastics, such as sintered ethylene vinyl acetate. The cross-section of the rod is not important and it may be conveniently circular, square or rectangular. One end of the rod acts as a root inserted into a bore formed in the end of the rigid stem 1, and staked in position by a pin 13 inserted transversely through the stem and rod. The projecting portion of the rod is capable of flexing resiliently through about 90° as depicted in FIGS. 9(*a*) and 9(*b*). Carried on the projecting portion of the rod is the application element which can be of any convenient form such a pad 14 or sock of open cell foam secured on the rod by adhesive or by a mechanical fixing means. The foam application element can be of any desirable shape, such as rounded as in FIG. 10 or more pointed as in FIG. 11.

The applicator of FIGS. 12 and 13 is of the same general construction as those FIGS. 8–11, but differs in that the application element 15 and the resiliently flexible rod 12 which connects to the stem are made in one piece, such as a sintered ethylene vinyl acetate moulding or casting. FIGS. 13 (*a*) and (*b*) illustrate the flexibility and indicate that the application element can be deflected to a position approximately 90° to the normal position aligned with stem.

The applicators of FIGS. 8–13 are used and operate by the application element flexing in the same way as described above in connection with the earlier embodiments.

Although described in connection with correction fluid application, applicators according to the invention can be used for other purposes, e.g. applying cosmetics or make-up. Providing for resilient deflection of the application element allows pressure to be applied without causing the application element to splay open, as occurs with the bristles of a brush. Applying a uniform film of fluid has the further advantage that the drying time is substantially constant for all portions of the film. Furthermore, the deflection of the application element can improve visibility and hence accuracy in use of the applicator.

What is claimed is:

1. A correction fluid product, comprising a bottle, defining a reservoir and an opening, a correction fluid within the reservoir, and an applicator, inserted through the opening, including a cap, a substantially rigid elongated stem extending from the cap, a connecting part, at a terminal end of the elongated stem, having a length that is less than the length of the elongated stem, and a porous absorbent applicator tip connected to an end of the stem by the connecting part, the connecting part defining a flexible region between said stem and an end of said applicator tip, whereby said connecting part is capable of flexing resiliently as the applicator tip is stroked across a paper surface, which allows the applicator tip to be deflected from a normal position in which the applicator tip is substantially aligned with the stem to a position substantially perpendicular to the normal position.

2. The product of claim 1 wherein the connecting part defines an axis about which the applicator tip is pivotable relative to the stem.

3. The product of claim 1 wherein the connecting part permits deflection of the applicator tip only in a single plane containing the stem axis.

4. The product of claim 1 wherein the connecting part comprises a substantially flat section.

5. The product of claim 1 wherein the connecting part comprises a rod of resiliently flexible material.

6. The product of claim 1 wherein the connecting part is integral with the stem.

7. The product of claim 1 wherein the connecting part includes a root portion fixed in a bore in the end of the stem.

8. The product of claim 1 wherein the applicator tip comprises a foam member.

9. The product of claim 1 wherein the applicator tip is integrally formed with the connecting part.

10. A correction fluid product, comprising a bottle including a reservoir and an opening, a correction fluid within the reservoir, and an applicator, inserted through the opening, including (a) a cap, (b) a substantially rigid elongated stem extending from the cap, (c) a connecting part, at a terminal end of the elongated stem, having a length that is less than the length of the elongated stem, and (d) a porous absorbent applicator tip connected to an end of the stem by the connecting part, the connecting part being capable of flexing resiliently as the applicator tip is stroked across a paper surface, which allows the applicator tip to be deflected from a normal position in which the applicator tip is substantially aligned with the stem to a position substantially perpendicular to the normal position.

11. A correction fluid product, comprising a bottle including a reservoir and an opening, a correction fluid within the reservoir, and an applicator, inserted through the opening, including (a) a cap, (b) a substantially rigid elongated stem extending from the cap, (c) a connecting part, at a terminal end of the stem, having a length that is less than the length of the elongated stem, and (d) a porous absorbent applicator tip connected to an end of the stem by the connecting part, the connecting part being capable of flexing resiliently as the applicator tip is stroked across a paper surface.

* * * * *